US010914313B2

(12) United States Patent
Yu et al.

(10) Patent No.: US 10,914,313 B2
(45) Date of Patent: Feb. 9, 2021

(54) HEAT DISSIPATION BLADE AND HEAT DISSIPATION FAN

(71) Applicant: Acer Incorporated, New Taipei (TW)

(72) Inventors: Shun-Ta Yu, New Taipei (TW); Wen-Neng Liao, New Taipei (TW); Cheng-Yu Cheng, New Taipei (TW); Jau-Han Ke, New Taipei (TW); Cheng-Wen Hsieh, New Taipei (TW)

(73) Assignee: Acer Incorporated, New Taipei (TW)

( * ) Notice: Subject to any disclaimer, the term of this patent is extended or adjusted under 35 U.S.C. 154(b) by 60 days.

(21) Appl. No.: 16/111,220

(22) Filed: Aug. 24, 2018

(65) Prior Publication Data

US 2019/0063451 A1 Feb. 28, 2019

(30) Foreign Application Priority Data

Aug. 25, 2017 (TW) ..... 106128905 A

(51) Int. Cl.
*F04D 29/30* (2006.01)
*F04D 29/28* (2006.01)

(52) U.S. Cl.
CPC ..... *F04D 29/281* (2013.01); *F04D 29/30* (2013.01); *F05B 2240/301* (2013.01);
(Continued)

(58) Field of Classification Search
CPC ..... F04D 29/281; F04D 29/30; F04D 29/66; F04D 29/666; F04D 29/667;
(Continued)

(56) References Cited

U.S. PATENT DOCUMENTS 2,238,749 A * 4/1941 Peltier ..... F04D 29/384 416/203
8,092,185 B2 * 1/2012 Hwang ..... F04D 29/666 416/223 R
9,388,823 B2 7/2016 Ohtsuka et al.
9,777,742 B2 * 10/2017 Yang ..... F04D 29/2216
(Continued)

FOREIGN PATENT DOCUMENTS

CN 1210705 3/1999
CN 101555887 10/2009
(Continued)

OTHER PUBLICATIONS

Dong Yao et al., "Guidelines for Safety Testing Technologies for Small Electric Appliances: Safety Testing of Electric Fans," with (partial) English translation thereof, Guangdong Economic Publishing House, Sep. 2009, pp. 1-6.

*Primary Examiner* — Eldon T Brockman
(74) *Attorney, Agent, or Firm* — JCIPRNET

(57) ABSTRACT

A heat dissipation fan including a hub and a plurality of heat dissipation blades is provided. The heat dissipation blades are arranged around the periphery of the hub. Each of the heat dissipation blades includes a curved surface body and a flow guiding portion. The curved surface body has a pressure bearing surface and a negative pressing surface opposite to the pressure bearing surface. The flow guiding portion is connected to the curved surface body. The flow guiding portion has a concave surface and a convex surface opposite to the concave surface, wherein the concave surface is recessed in the pressure bearing surface and the convex surface protrudes outward from the negative pressing surface.

6 Claims, 6 Drawing Sheets

(52) U.S. Cl.
CPC ... *F05B 2250/711* (2013.01); *F05B 2250/712* (2013.01); *F05B 2260/224* (2013.01); *F05D 2240/305* (2013.01); *F05D 2240/307* (2013.01); *F05D 2250/712* (2013.01)

(58) Field of Classification Search
CPC ..... F05D 2250/712; F05D 2240/305; F05D 2240/307; F05B 2250/711; F05B 2260/224; F05B 2240/301; F05B 2250/712
See application file for complete search history.

(56) References Cited

U.S. PATENT DOCUMENTS

| | | | | |
|---|---|---|---|---|
| 2009/0196754 | A1* | 8/2009 | Hwang | F04D 29/667 416/223 R |
| 2014/0086754 | A1 | 3/2014 | Seiji et al. | |
| 2014/0127029 | A1* | 5/2014 | Yang | F04D 29/666 416/223 B |

FOREIGN PATENT DOCUMENTS

| | | |
|---|---|---|
| CN | 203067351 | 7/2013 |
| CN | 203098387 | 7/2013 |
| CN | 203430862 | 2/2014 |
| CN | 205298058 | 6/2016 |
| JP | 2005264803 | 9/2005 |
| KR | 100272539 | 1/2001 |
| TW | I398210 | 6/2013 |
| TW | I427220 | 2/2014 |
| TW | 201518611 | 5/2015 |
| TW | M545286 | 7/2017 |

* cited by examiner

HEAT DISSIPATION BLADE AND HEAT DISSIPATION FAN

CROSS-REFERENCE TO RELATED APPLICATION

This application claims the priority benefit of Taiwan application serial no. 106128905, filed on Aug. 25, 2017. The entirety of the above-mentioned patent application is hereby incorporated by reference herein and made a part of this specification.

BACKGROUND OF THE INVENTION

1. Field of the Invention

The invention relates to a blade and a fan, and particularly relates to a heat dissipation blade and a heat dissipation fan.

2. Description of Related Art

Heat dissipation fans are disposed in most of the common electronic apparatuses, such as servers, main bodies of personal desktop computers, all-in-one (AIO) computers, laptop computers, or displays. Through an airflow generated by the heat dissipation fan, heat generated during operation of the electronic apparatus is discharged out of the apparatus.

Taking centrifugal fans as an example, a centrifugal fan is normally manufactured by integrally forming a hub and blades through plastic injection. Due to limitations on materials and manufacturing processes, it is difficult to reduce the thickness of the plastic blades. As a consequence, it is challenging to increase the number of plastic blades arranged on the circumference of the hub. If the number of plastic blades is increased, a total weight of the centrifugal fan may be significantly increased. Due to an excessive load, if a fan speed of the centrifugal fan is increased, high-frequency noises may be generated.

SUMMARY OF THE INVENTION

The invention provides a heat dissipation fan and heat dissipation blades capable of increasing heat dissipation efficiency.

A heat dissipation blade according to an embodiment of the invention is adapted to be fixed to a hub. The heat dissipation blade includes a curved surface body and a flow guiding portion. The curved surface body has a pressure bearing surface and a negative pressing surface opposite to the pressure bearing surface. The flow guiding portion is connected to the curved surface body. In addition, the flow guiding portion has a concave surface and a convex surface opposite to the concave surface, the concave surface is recessed in the pressure bearing surface, and the convex surface protrudes outward from the negative pressing surface.

A heat dissipation fan according to an embodiment of the invention includes a hub and a plurality of heat dissipation blades. The heat dissipation blades are arranged around the periphery of the hub. Each of the heat dissipation blades includes a curved surface body and a flow guiding portion. The curved surface body has a pressure bearing surface and a negative pressing surface opposite to the pressure bearing surface. The flow guiding portion is connected to the curved surface body. In addition, the flow guiding portion has a concave surface and a convex surface opposite to the concave surface, the concave surface is recessed in the pressure bearing surface, and the convex surface protrudes outward from the negative pressing surface.

Based on the above, the heat dissipation blades in the heat dissipation fan according to the embodiments of the invention have a greater flow guiding area. When the heat dissipation fan operates, a flow rate of the heat dissipation airflow may be increased to attain desirable heat dissipation efficiency.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
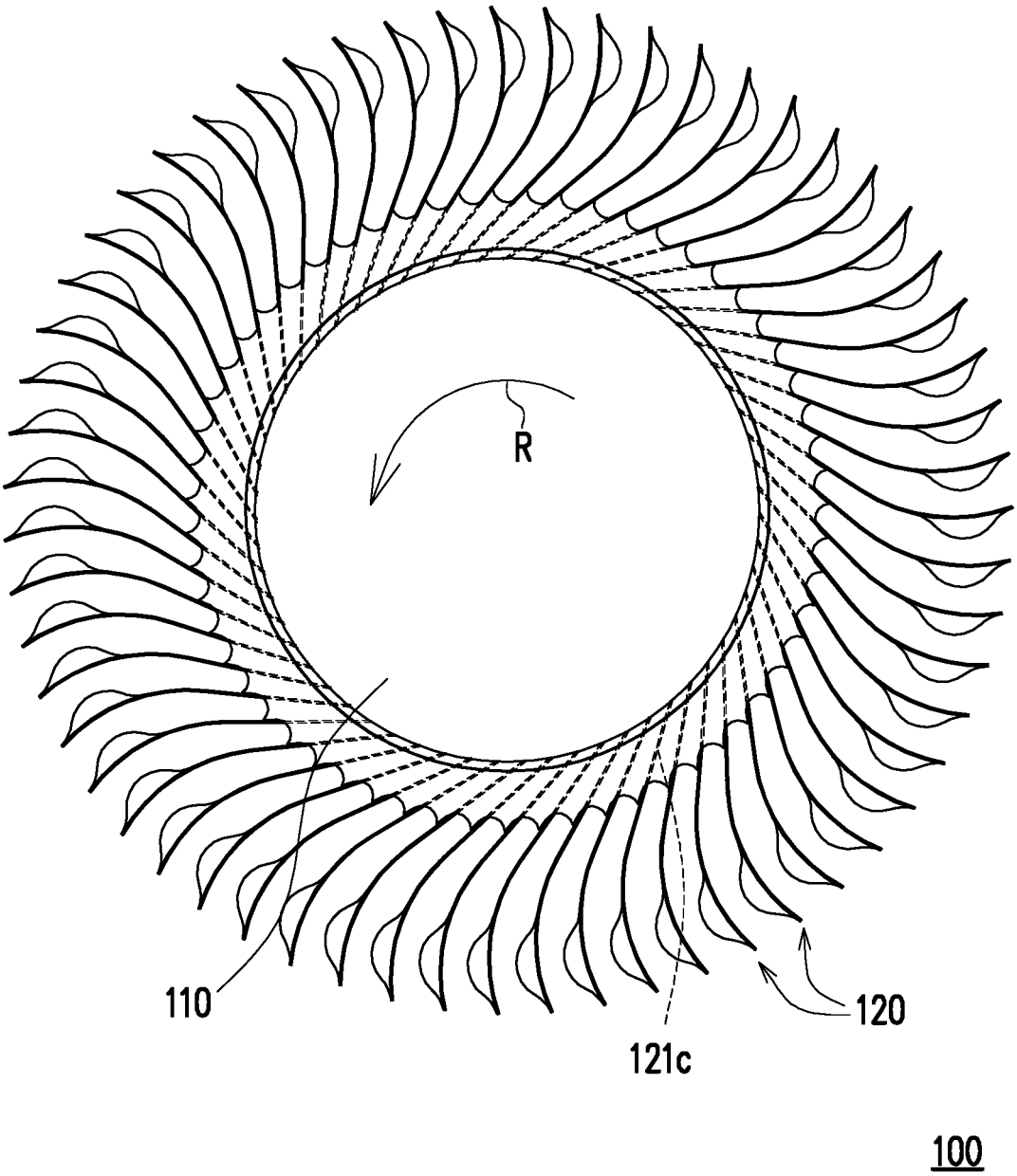
FIG. 1A is a schematic view illustrating a heat dissipation fan according to a first embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 1C:
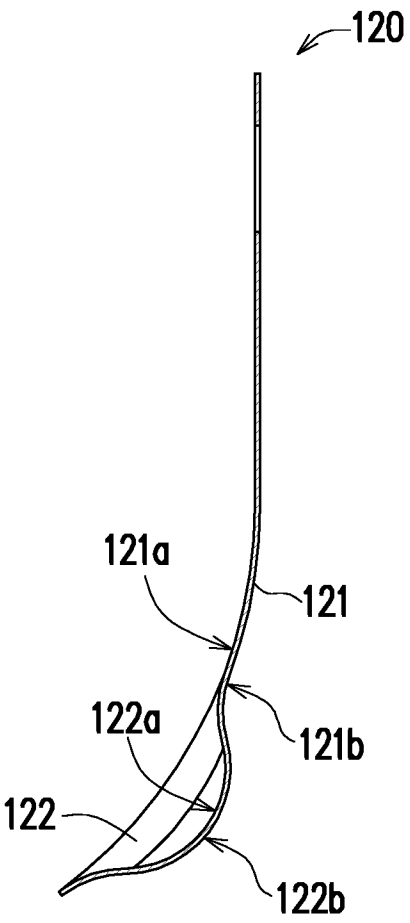
FIG. 1C is a schematic cross-sectional view illustrating the heat dissipation blade of FIG. 1B taken along a cross-sectional line A-A.
Figure 1B:
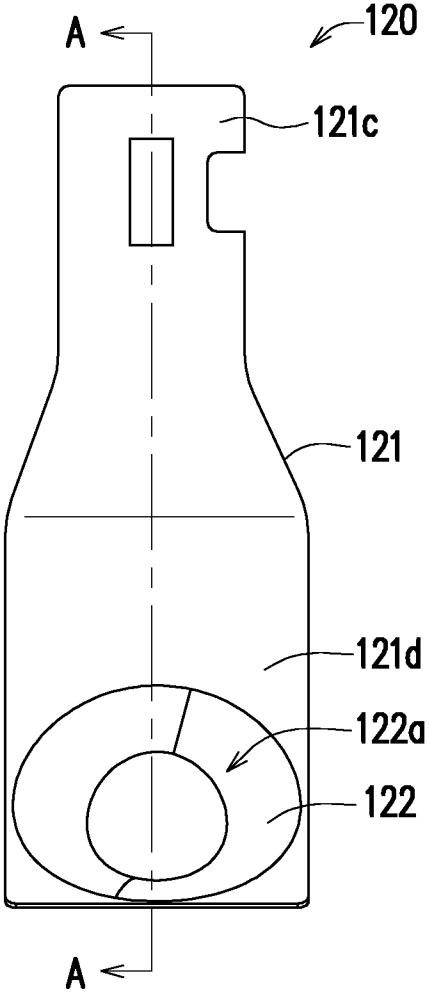
FIG. 1B is a schematic view illustrating a heat dissipation blade according to the first embodiment of the invention.

FIG. 1A is a schematic view illustrating a heat dissipation fan according to a first embodiment of the invention. FIG. 1B is a schematic view illustrating a heat dissipation blade according to the first embodiment of the invention. FIG. 1C is a schematic cross-sectional view illustrating the heat dissipation blade of FIG. 1B taken along a cross-sectional line A-A. Referring to FIGS. 1A to 1C, in the embodiment, a heat dissipation fan 100 may be a centrifugal fan. The heat dissipation fan 100 includes a hub 110 and a plurality of heat dissipation blades 120. In addition, the heat dissipation blades 120 are arranged around the periphery of the hub 110. The hub 110 and the heat dissipation blades 120 respectively fixed to the hub 110 may be manufactured by insert molding, for example. During manufacturing, one end of each of the heat dissipation blades 120 is placed in a molding cavity for forming the hub 110, and then the hub 110 is formed in the molding cavity by injection molding. Accordingly, the heat dissipation blades 120 are fixed to the hub 110 when the hub 110 is manufactured. The hub 110 may be plastic, and the heat dissipation blades 120 may be metallic. However, the invention does not intend to impose a limitation on the materials of the hub and the heat dissipation blades.

Taking one of the heat dissipation blades 120 as an example, the heat dissipation blade 120 includes a curved surface body 121 and a flow guiding portion 122. As an example, the curved surface body 121 is described as being connected to one flow guiding portion 122 in the embodiment. For example, the heat dissipation fan 100 is configured to rotate along a rotating direction R, such as a counterclockwise direction. In addition, the curved surface body 121 has a pressure bearing surface 121*a* and a negative pressing surface 121*b* opposite to the pressure bearing surface 121*a*. In addition, the pressure bearing surface 121*a* is configured to receive an airflow entering the heat dissipation fan 100 when the heat dissipation fan 100 operates. Besides, the curved surface body 121 further has a combining end 121*c* and a flow guiding end 121*d* opposite to the combining end 121*c*. In addition, the combining end 121*c* is fixed to the hub 110, and the flow guiding portion 122 is disposed to be adjacent to an end edge of the flow guiding end 121*d*. In other words, a distance between the flow guiding portion 122 and the hub 110 is greater than a distance between the flow guiding portion 122 and the end edge of the flow guiding end 121*d*.

The curved surface body 121 and the flow guiding portion 122 may be an integrally formed sheet metal component. In addition, the flow guiding portion 122 is formed at the curved surface body 121 by punching. To be more specific, the flow guiding portion 122 has a concave surface 122*a* and a convex surface 122*b* opposite to the concave surface 122*a*. In addition, the concave surface 122*a* is recessed in the pressure bearing surface 121*a*, and the convex surface 122*b* protrudes outward from the negative pressing surface 121*b*. The pressuring bearing surface 121*a* of the curved surface body 121 and the concave surface 122*a* of the flow guiding portion 122 smoothly connected to each other define a flow guiding surface receiving the airflow entering the heat dissipation fan 100 when the heat dissipation fan 100 operates. Compared with a conventional plate-like heat dissipation blade or heat dissipation blade with a single curved surface, the flow guiding surface of the heat dissipation blade 120 of the embodiment has a greater area. Thus, when the heat dissipation fan 100 operates, the heat dissipation blades 120 arranged around the periphery of the hub 110 are able to increase a flow rate of a heat dissipation airflow to attain desirable heat dissipation efficiency.

In the embodiment, the pressure bearing surface 121*a* of the curved surface body 121 and the concave surface 122*a* of the flow guiding portion 122 are respectively concave curved surfaces, and radii of curvature of the pressure bearing surface 121*a* and the concave surface 122*a* are different. Comparatively, the negative pressing surface 121*b* of the curved surface body 121 and the convex surface 122*b* of the flow guiding portion 122 are respectively convex curved surfaces, and radii of curvature of the negative pressing surface 121*b* and the convex surface 122*b* are different. In other embodiments, the concave surface of the flow guiding portion may also be an inclined surface, a stepped surface, other irregular surfaces, or a combination of at least two of the curved surface, the inclined surface, and the stepped surface.

While a flow rate of a heat dissipation airflow of the conventional heat dissipation fan (e.g., a fan configured with plate-like heat dissipation blades or heat dissipation blades each with a single curved surfaces) may be increased by increasing a fan speed or the number of heat dissipation blades, the motor may bear an excessive load or high-frequency noises may be generated. Comparatively, without increasing the fan speed or the number of heat dissipation blades, the heat dissipation fan 100 of the embodiment is still able to increase the flow rate of the heat dissipation airflow. Therefore, the load of the motor may be reduced, and the high-frequency noises may be avoided.

Furthermore, under a condition that the fan speeds and the numbers of heat dissipation blades are equal, the flow rate of the heat dissipation airflow generated per unit time by the heat dissipation fan 100 of the embodiment is greater than the flow rate of the heat dissipation air flow generated per unit time by the conventional heat dissipation fan (e.g., a fan configured with plate-like heat dissipation blades or heat dissipation blades each with a single curved surface). In other words, under a condition that the numbers of heat dissipation blades are the same, even if the fan speed of the heat dissipation fan 100 of the embodiment is slowed down, the heat dissipation fan 100 of the embodiment is still able to generate the heat dissipation airflow with the same flow rate as that of the conventional heat dissipation fan (e.g., a fan configured with plate-like heat dissipation blades or heat dissipation blades each with a single curved surface). To put it differently, under a condition that the fan speeds are the same, even if the number of blades of the heat dissipation fan 100 of the embodiment is reduced, the heat dissipation fan 100 of the embodiment is still able to generate the heat dissipation airflow with the same flow rate as that of the conventional heat dissipation fan (e.g., a fan configured with plate-like heat dissipation blades or heat dissipation blades each with a single curved surface).

In the following, heat dissipation blades 220 to 420 of other embodiments are described as examples. The heat dissipation blades 220 to 420 in the embodiments are applicable as the heat dissipation blades of the invention. In addition, the heat dissipation blades 220 to 240 follow design principles same as or similar to those of the heat dissipation blades 120 of the first embodiments, and structures of the dissipation blades 220 to 240 are substantially similar to the structure of the heat dissipation blades 120 of the first embodiment. Thus, descriptions about the technical contents and effects the same as those of the first embodiment are omitted in the embodiments.

Figure 2B:
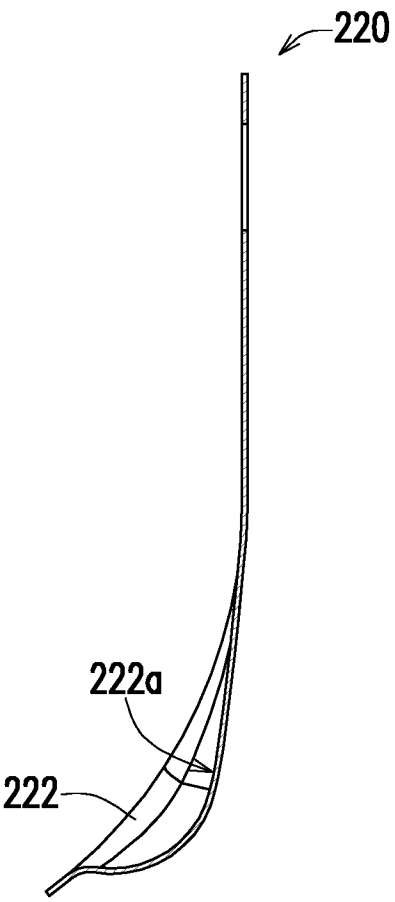
FIG. 2B is a schematic cross-sectional view illustrating the heat dissipation blade of FIG. 2A taken along a cross-sectional line B-B.
Figure 2A:
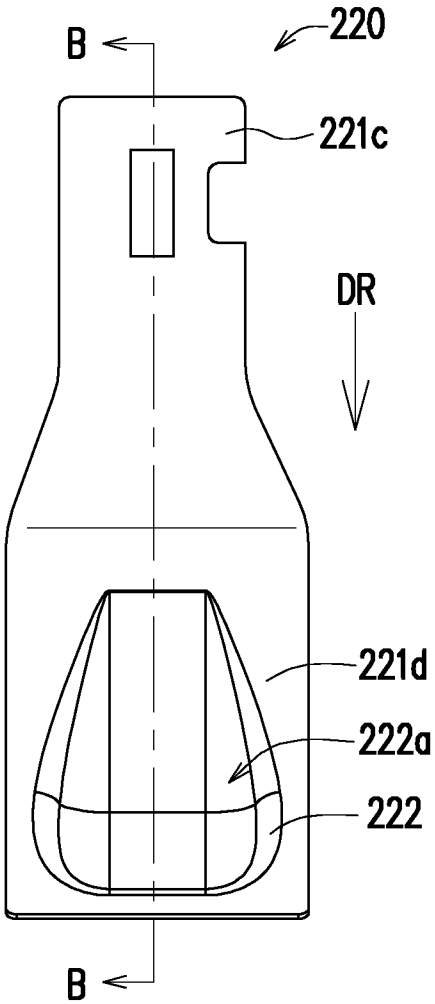
FIG. 2A is a schematic view illustrating a heat dissipation blade according to a second embodiment of the invention.

FIG. 2A is a schematic view illustrating a heat dissipation blade according to a second embodiment of the invention. FIG. 2B is a schematic cross-sectional view illustrating the heat dissipation blade of FIG. 2A taken along a cross-sectional line B-B. Referring to FIGS. 2A and 2B, the heat dissipation blade 220 of the embodiment is substantially similar to the heat dissipation blade 120 of the first embodiment. A difference therebetween is that geometric shapes of the concave surfaces of the flow guiding portions are different. In the first embodiment, the geometric shape of the concave surface 122*a* of the flow guiding portion 122 is nearly circular or elliptic, as shown in FIG. 1A. In the embodiment, a concave surface 222*a* of a flow guiding portion 222 is in a geometric shape where a width is increased from a combining end 221*c* toward an end edge of a flow guiding end 221*d* (i.e., along a direction DR).

Figure 3B:
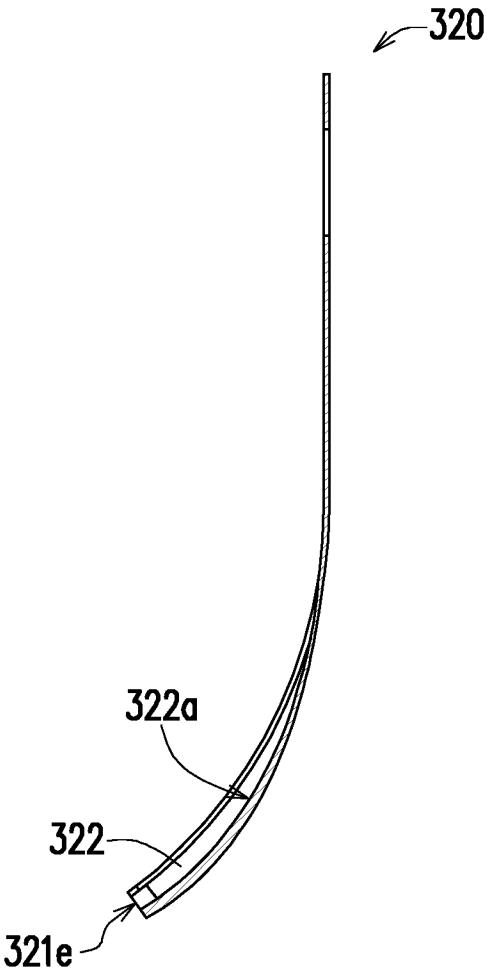
FIG. 3B is a schematic cross-sectional view illustrating the heat dissipation blade of FIG. 3A taken along a cross-sectional line C-C.
Figure 3A:
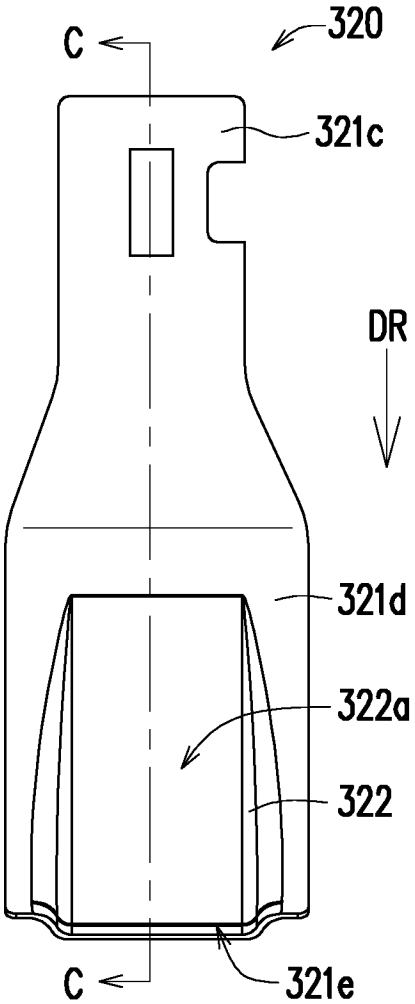
FIG. 3A is a schematic view illustrating a heat dissipation blade according to a third embodiment of the invention.

FIG. 3A is a schematic view illustrating a heat dissipation blade according to a third embodiment of the invention. FIG. 3B is a schematic cross-sectional view illustrating the heat dissipation blade of FIG. 3A taken along a cross-sectional line C-C. Referring to FIGS. 3A and 3B, the heat dissipation blade 320 of the embodiment is substantially similar to the heat dissipation blade 220 of the second embodiment. A difference therebetween is that geometric shapes of the concave surfaces of the flow guiding portions are different. In the second embodiment, the concave surface 222*a* of the flow guiding portion 222 is in a geometric shape where the width is increased from the combining end 221*c* toward the end edge of the flow guiding end 221*d* (i.e., along the direction DR). In the embodiment, a concave surface 322*a* of a flow guiding portion 322 is in a geometric shape where a width is increased from a combining end 321*c* toward an end edge of a flow guiding end 321*d* (i.e., along the direction DR), and the flow guiding portion 322 is formed with an opening 321*e* at the end edge of the flow guiding end 321*d*. In the direction DR, a variation in width of the concave surface 222*a* of the flow guiding portion 222 of the second embodiment is greater than a variation in width of the concave surface 322*a* of the flow guiding portion 322 of the embodiment.

Figure 4B:
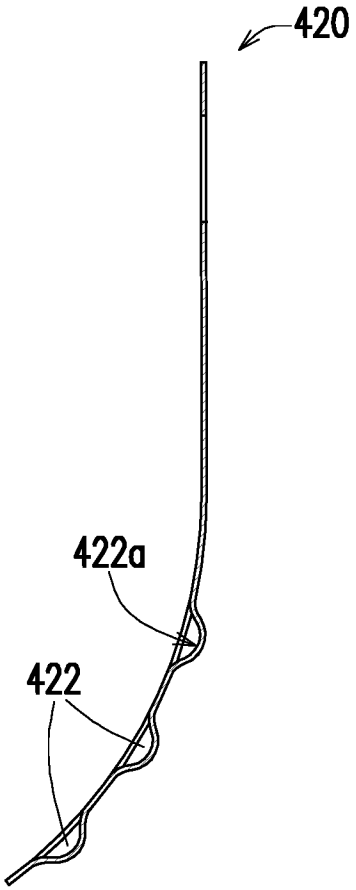
FIG. 4B is a schematic cross-sectional view illustrating the heat dissipation blade of FIG. 4A taken along a cross-sectional line D-D.
Figure 4A:
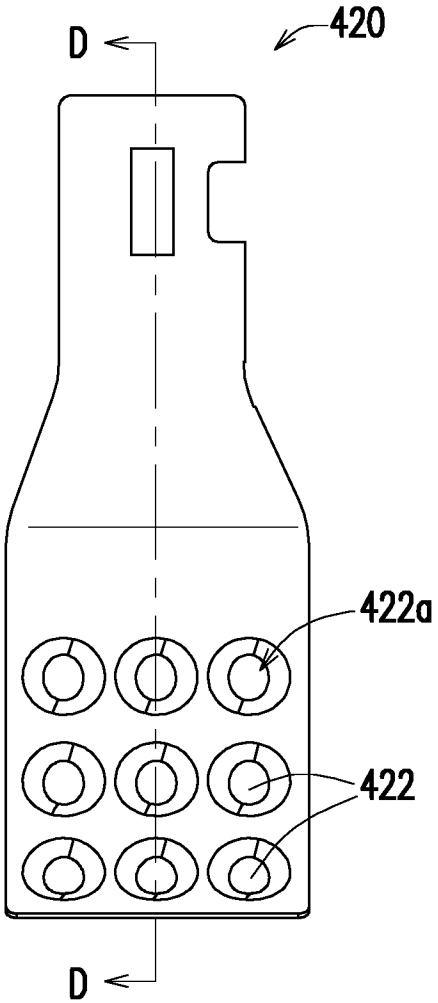
FIG. 4A is a schematic view illustrating a heat dissipation blade according to a fourth embodiment of the invention.

FIG. 4A is a schematic view illustrating a heat dissipation blade according to a fourth embodiment of the invention. FIG. 4B is a schematic cross-sectional view illustrating the heat dissipation blade of FIG. 4A taken along a cross-sectional line D-D. Referring to FIGS. 4A and 4B, the heat dissipation blade 420 of the embodiment is substantially similar to the heat dissipation blade 120 of the first embodiment. A difference therebetween lies in sizes and numbers of the flow guiding portions. In the embodiment, the number of a flow guiding portion 422 is plural. In addition, the flow guiding portions 422 are arranged into a matrix, and an area of a concave surface 422*a* of each of the flow guiding portions 422 is smaller than an area of the concave surface 122*a* of the flow guiding portion 122 of the first embodiment.

In the following, a heat dissipation fan 100A of another embodiment is described as an example. Heat dissipation blades in the heat dissipation fan 100A of the embodiment are substantially similar to the heat dissipation blades 120 of the first embodiment. Thus, descriptions about the technical contents and effects the same as those of the first embodiment are omitted in the following.

Figure 5:
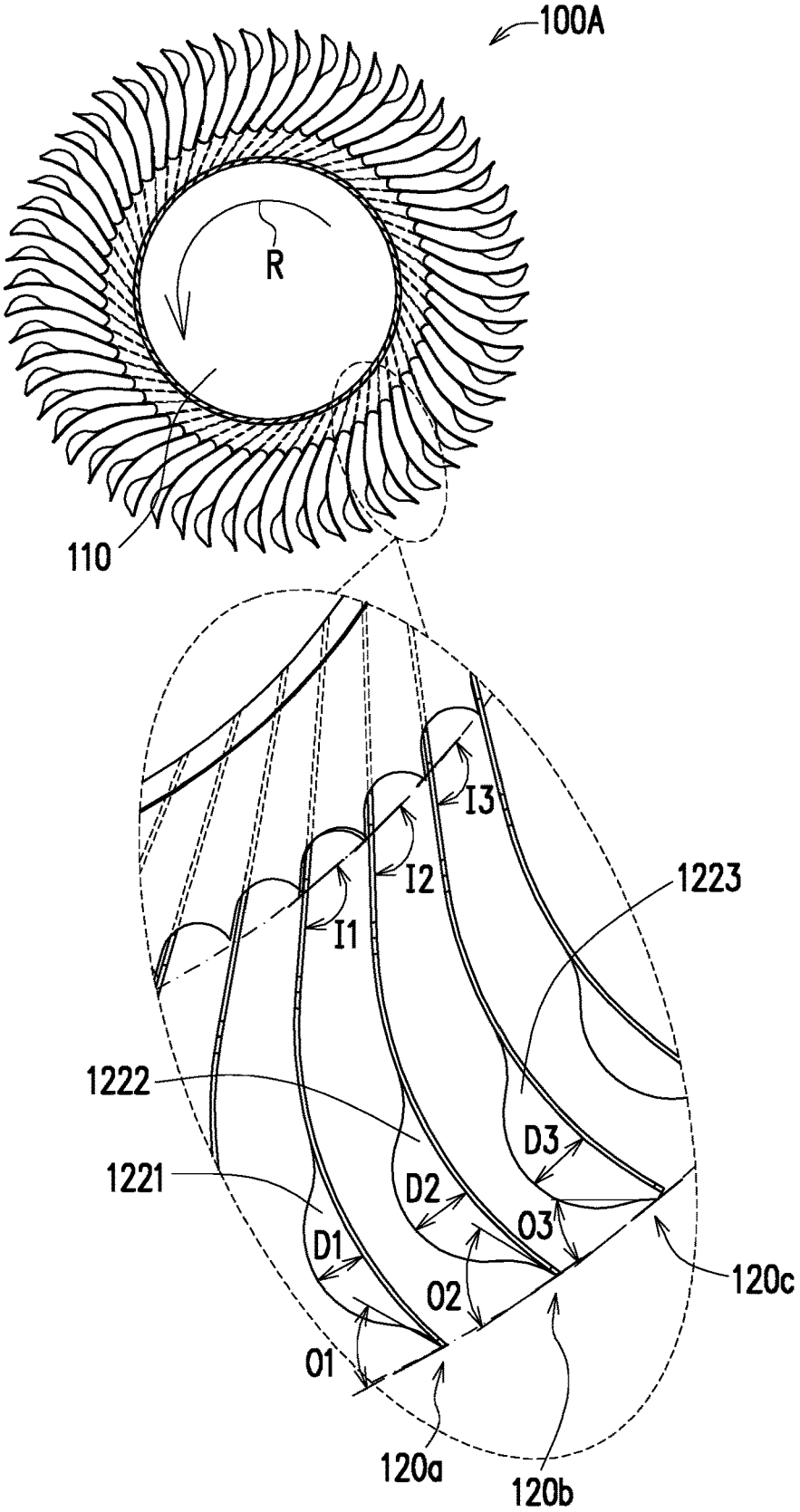
FIG. 5 is a schematic view illustrating a heat dissipation fan according to another embodiment of the invention.

FIG. 5 is a schematic view illustrating a heat dissipation fan according to another embodiment of the invention. Referring to FIG. 5, the heat dissipation blades (including a plurality of first blades 120*a*, a plurality of second blades 120*b*, and a plurality of third blades 120*c*) are in a geometric shape substantially similar to the heat dissipation blades 120 in the heat dissipation fan 100 of the first embodiment. Nevertheless, the embodiment differs in that the heat dissipation blades are regularly arranged on the periphery of the hub 110 along a rotational direction R in an order from the first blade 120*a* to the second blade 120*b* and then to the third blade 120*c* (i.e., each of the second blades 120*b* is disposed between one of the first blades 120*a* and one of the third blades 120*c* that are adjacent). In addition, a depth D1 of a flow guiding portion 1221 of the first blade 120*a* is less than a depth D2 of a flow guiding portion 1222 of the second blade 120*b*, and the depth D2 of the flow guiding portion 1222 of the second blade 120*b* is less than a depth D3 of a flow guiding portion 1223 of the third blade 120*c*.

In other words, an area of a flow guiding surface of the first blade 120*a* for receiving an airflow is smaller than an area of a flow guiding surface of the second blade 120*b* for receiving an air flow, and the area of the flow guiding surface of the second blade 120*b* for receiving the air flow is smaller than an area of a flow guiding surface of the third blade 120*c* for receiving an airflow. In other embodiments, the heat dissipation blades arranged around the periphery of the hub may be regularly arranged along the rotational direction of the heat dissipation fan in an ascending or descending order based the areas of the flow guiding surfaces for receiving the airflows. Comparatively, the depths of the flow guiding portions 122 of the heat dissipation blades 120 and the areas of the flow guiding surfaces of the heat dissipation blades 120 for receiving the airflows in the heat dissipation fan 100 of the first embodiment are the same.

Besides, an entrance angle I1 and an exit angle O1 of the first blade 120*a*, an entrance angle I2 and an exit angle O2 of the second blade 120*b*, and an entrance angle I3 and an exit angle O3 of the third blade 120*c* are respectively different. More specifically, the hub 110 has an outer circumference (represented by a dot dash line passing through where the heat dissipation blades and the hub 110 are connected in the figure). Along where the heat dissipation blades and the hub 110 are connected, the entrance angles are defined as angles included between tangent lines passing through the curved surface bodies of the heat dissipation blades and tangent lines passing though the outer circumference of the hub 110. In addition, the end edges of the heat dissipation blades define an outer circumference (represented by a dot dash line passing through the end edges of the heat dissipation blades in the figure). At the end edges of the heat dissipation blades, exit angles are defined as angles included between tangent lines passing through the curved surface bodies of the heat dissipation blades and tangent lines passing through the outer circumference defined by the end edges of the heat dissipation blades.

In the embodiment, since the areas of the flow guiding surfaces for receiving the air flows of the first blade 120*a*, the second blade 120*b*, and the third blade 120*c* are respectively different, pressures exerted at the flow guiding surfaces of the first blade 120*a*, the second blade 120*b*, and the third blade 120*c* when the heat dissipation fan 100A operates are also respectively different. Therefore, energy is dispersed and high-frequency noises are avoided. Besides, since the entrance angles of the first blade 120*a*, the second blade 120*b*, and the third blade 120*c* are configured to be respectively different, and the exit angles of the first blade 120*a*, the second blade 120*b*, and the third blade 120*c* are configured to be respectively different, the energy may also be dispersed, and high-frequency noises may be avoided.

Even though the entrance angles of the first blade 120*a*, the second blade 120*b*, and the third blade 120*c* are configured to be respectively different, and the exit angles of the first blade 120*a*, the second blade 120*b*, and the third blade 120*c* are configured to be respectively different in the embodiment, the invention is not limited thereto. In other embodiments, the entrance angles of the heat dissipation blades may be configured to be the same, and the exit angles of the heat dissipation blades may also be configured to be the same. Alternatively, the entrance angles of the heat dissipation blades may be configured to be the same, but the exit angles of the heat dissipation blades may be configured to be different. Or, the entrance angles of the heat dissipation blades may be configured to be different, but the exit angles of the heat dissipation blades may be configured to be the same.

In view of the foregoing, the heat dissipation blades in the heat dissipation fan according to the embodiments of the invention have a greater flow guiding area. When the heat dissipation fan operates, the flow rate of the heat dissipation airflow may be increased to attain desirable heat dissipation efficiency. While the conventional heat dissipation fan is able to increase the flow rate of the heat dissipation airflow by increasing the fan speed or the number of the heat dissipation blades, the motor may bear an excessive load or high-frequency noises may be generated. Comparatively, without increasing the fan speed or the number of heat dissipation blades, the heat dissipation fan according to the embodiments of the invention is still able to increase the flow rate of the heat dissipation airflow. Therefore, the load of the motor may be reduced, and the high-frequency noises may be avoided.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A heat dissipation fan, comprising:

a hub; and a plurality of heat dissipation blades, arranged around a periphery of the hub, wherein each of the heat dissipation blades comprises:

a curved surface body, extending in a direction and having a pressure bearing surface, a negative pressing surface opposite to the pressure bearing surface, and two lateral sides parallel to the direction; and a flow guiding portion, connected to the curved surface body, wherein the flow guiding portion has a concave surface and a convex surface opposite to the concave surface, the concave surface is recessed in the pressure bearing surface, and the convex surface protrudes outward from the negative pressing surface, wherein distances between the two lateral sides across the flow guiding portion are constant along the direction, wherein the heat dissipation fan is a centrifugal fan, the heat dissipation blades comprise a first blade, a second blade, and a third blade, a depth of the flow guiding portion of the concave surface of the first blade is less than a depth of the flow guiding portion of the second blade, the depth of the flow guiding portion of the second blade is less than a depth of the flow guiding portion of the third blade, and the heat dissipation blades are regularly arranged along a rotational direction in an order from the first blade to the second blade and then to the third blade.

2. The heat dissipation fan as claimed in claim 1, wherein each of the curved surface bodies further has a combining end and a flow guiding end opposite to the combining end, each of the combining ends is fixed to the hub, and each of the flow guiding portions is disposed to be adjacent to an end edge of the corresponding flow guiding end.

3. The heat dissipation fan as claimed in claim 1, wherein each of the curved surface bodies and the corresponding flow guiding portion are an integrally formed sheet metal component, and each of the flow guiding portions is formed at the corresponding curved surface body by punching.

4. The heat dissipation fan as claimed in claim 1, wherein each of the concave surfaces is a concave curved surface.

5. The heat dissipation fan as claimed in claim 4, wherein each of the pressure bearing surfaces is a concave curved surface, and a radius of curvature of each of the pressure bearing surfaces is different from a radius of curvature of the corresponding concave surface.

6. The heat dissipation fan as claimed in claim 1, wherein an entrance angle and an exit angle of the first blade, an entrance angle and an exit angle of the second blade, and an entrance angle and an exit angle of the third blade are respectively different.

* * * * *